US008305166B2

(12) United States Patent
Kojima et al.

(10) Patent No.: US 8,305,166 B2
(45) Date of Patent: Nov. 6, 2012

(54) ELECTROMAGNETIC RELAY

(75) Inventors: Katsuto Kojima, Sendai (JP); Kei Chiba, Sendai (JP); Kouichi Mutou, Sendai (JP)

(73) Assignee: NEC Tokin Corporation, Miyagi (JP)

( * ) Notice: Subject to any disclaimer, the term of this patent is extended or adjusted under 35 U.S.C. 154(b) by 0 days.

(21) Appl. No.: 12/995,129

(22) PCT Filed: Mar. 30, 2009

(86) PCT No.: PCT/JP2009/056521

§ 371 (c)(1),
(2), (4) Date: Jan. 28, 2011

(87) PCT Pub. No.: WO2009/145004

PCT Pub. Date: Dec. 3, 2009

(65) Prior Publication Data

US 2011/0121926 A1 May 26, 2011

(30) Foreign Application Priority Data

May 30, 2008 (JP) ..... 2008-143065

(51) Int. Cl.
*H01H 51/22* (2006.01)

(52) U.S. Cl. ..... 335/78; 335/80

(58) Field of Classification Search ..... 335/78
See application file for complete search history.

(56) References Cited

U.S. PATENT DOCUMENTS

| | | | | |
|---|---|---|---|---|
| 6,414,576 | B1 | 7/2002 | Nakamura et al. | |
| 6,781,490 | B2 * | 8/2004 | Funayama et al. | 335/78 |
| 2003/0067372 | A1 | 4/2003 | Funayama et al. | |
| 2006/0226935 | A1 * | 10/2006 | Kon et al. | 335/78 |

FOREIGN PATENT DOCUMENTS

| | | | |
|---|---|---|---|
| JP | 02-094333 | A | 4/1990 |
| JP | 05-182575 | A | 7/1993 |
| JP | 2001-185015 | A | 7/2001 |
| JP | 2003-123607 | A | 4/2003 |

* cited by examiner

*Primary Examiner* — Elvin G Enad
*Assistant Examiner* — Lisa Homza
(74) *Attorney, Agent, or Firm* — Sughrue Mion, PLLC

(57) ABSTRACT

To provide an electromagnetic relay having a reduced size, high conductivity, a high insulating performance between two fixed contact terminals and between each of the fixed contact terminals and backstop, a small number of factors causing a failure, and high reliability of electric contact.

An electromagnetic relay has an electromagnetic block provided with a movable contact spring 14 swung by current flowing in a coil, two fixed contact terminals 22 and 22' each having a fixed contact, a backstop 23 having two movable contact abutment portions, and a base block 2 for retaining the above components. The base block 2 has a base portion 20 having substantially a rectangular shape, fixed contact terminal retaining portions 21 and 21' extending vertically from two opposing sides of the rectangle so as to retain the two fixed contact terminals, and a backstop retaining portion 24 extending vertically from the center portion of one of the remaining two opposing sides of the rectangle.

8 Claims, 5 Drawing Sheets

ELECTROMAGNETIC RELAY

TECHNICAL FIELD

The present invention relates to an electromagnetic relay mounted on a printed circuit board, etc., as an electric component for, e.g., an automobile.

BACKGROUND ART

Along with an increase in the mounting rate of electric components mounted in an automobile, miniaturization and high-density packaging of electric devices mounted in an automobile are proceeding, and miniaturization is also required for an electromagnetic relay mounted in such an electric device. Meanwhile, along with miniaturization of the electromagnetic relay, problems such as a reduction in contact drive performance due to a reduction in the coil capacity, a reduction in energization performance due to an increase of resistance of a current carrying path in the electromagnetic relay, and a reduction in insulation performance due to a reduction in the distance between terminals are arisen, a further improvement is required for these performances. An improvement in contact stability between contacts or improvement in assembly accuracy of components is also necessary.

In recent years, in order to increase contact capacity, an electromagnetic relay in which two movable contacts are provided at the leading end of one movable spring is adopted. Such an electromagnetic relay has a fixed contact at a position opposite to one swing direction of the movable contact and a backstop at a position opposite to the other swing direction of the movable contact.

For example, an electromagnetic relay of such a type has a configuration in which a terminal board provided with two make fixed contact terminals having fixed contacts corresponding to two movable contacts provided in a movable contact spring and a backstop is arranged on the front surface of a coil of an electromagnetic block. A protrusion for separating two fixed contact terminals is formed in the terminal board. The two fixed contact terminals are separated by the protrusion and a cover inner surface to thereby prevent insulation breakdown between the fixed contact terminals (refer to, e.g., Patent Document 1).

As another example, there has been proposed a configuration in which two make fixed contact terminals and a backstop are directly secured to support grooves provided at the edge of a coil bobbin of an electromagnetic block (refer to, e.g., Patent Document 2).

Patent Document 1: JP-A-2003-123607
Patent Document 2: JP-A-5-182575

DISCLOSURE OF THE INVENTION

Problems to be Solved by the Invention

However, since the conventional electromagnetic relay disclosed in Patent Document 1 adopts a structure in which the plurality of fixed contact terminals and backstop are secured to a single insulating board used as a terminal board, and the insulating board is attached to the coil front surface which is one of the surfaces surrounding an electromagnetic block, some problems are arisen.

A first problem is as follows. A distance between the fixed contact terminals and distance between each fixed contact terminal and backstop are small, so that even when the protrusion is used to separate them, a sufficient insulation distance cannot be ensured if a cover and protrusion are insufficiently adhered to each other, which may cause short-circuit between the terminals because of metal scrap generated at the time of checking of contacts.

A second problem is as follows. Since the plurality of fixed contact terminals, backstop, and protrusion are collectively secured to the single terminal plate, it is difficult to increase the width of the board constituting each fixed contact terminal for increasing the width dimension of a current carrying path, which makes it possible to achieve a relay having a reduced size and high conductivity.

A third problem is as follows. Since the backstop retained by the terminal plate is fixed such that the board width direction thereof is perpendicular to the surface of the terminal board, i.e., coil surface, a space for ensuring the winding width of the coil and for the abovementioned insulation. This increases wasted space, making it difficult to achieve miniaturization.

Further, since the conventional electromagnetic relay disclosed in Patent Document 2 adopts a structure in which the make fixed contact terminals and backstop are secured to the edge of a coil bobbin, the following problems are arisen. A first problem is as follows. If a failure occurs while the movable contact and make fixed contact are being connected, the edge portion of the coil bobbin is melt by the heat of the coil and heat generated due to conduction between the movable contact spring and make fixed contact terminal to cause the movable contact and fixed contact to be firmly fixed to each other while being connected, which may result in malfunction in which current is not cut off but continues to flow. This means that a fail-safe system functions poorly.

A second problem is as follows. Since a press-fit structure of the support groove of the coil bobbin and fixed contact terminals is formed near the contacts, it is highly possible that electric contact trouble may occur due to cutting scrap generated during the press-fit process.

An object of the present invention is therefore to provide an electromagnetic relay having a reduced size, high conductivity, a high insulating performance between the two fixed contact terminals and between each of the fixed contact terminals and backstop, a small number of factors causing a failure, and high reliability of electric contact.

Means for Solving the Problems

To achieve the above object, according to the present invention, there is provided an electromagnetic relay characterized by including: an electromagnetic block having a coil and a movable contact spring swung by current flowing in the coil; two fixed contact terminals each provided with a fixed contact; a backstop having two movable contact abutment portions; and a base block for retaining the electromagnetic block, fixed contact terminals, and backstop. The movable contact spring has two movable contacts at its leading end portions extending from its base portion fixed to the base block. The fixed contacts of the two fixed contact terminals are provided at one side of the swinging direction of the two movable contacts so as to abut with the two movable contacts respectively, and two movable contact abutment portions of the backstop are provided at the other side of the swinging direction of the two movable contacts so as to abut with the two movable contacts respectively. The fixed contact terminals are retained by fixed contact terminal retaining portions which are provided outside a projection obtained by perpendicularly projecting the movable contact spring on the surface of the base block so as to sandwich the part of the movable contact spring that extends from the base portion thereof toward a contact point. The backstop is retained by a backstop retaining portion which is provided at the portion outside the projection and opposite to the base portion of the movable contact spring.

In the electromagnetic relay, the base block has a base portion having substantially a rectangular surface, fixed contact terminal retaining portions extending vertically from two opposing sides of the rectangle so as to retain the two fixed contact terminals, and a backstop retaining portion extending vertically from the center portion of one of the remaining two opposing sides of the rectangle.

The movable contacts are swung vertically with respect to the base portion of the base block. The movable contact abutment portions of the backstop are disposed in the upper side of the swinging direction, and the fixed contacts are disposed in the lower side of the swinging direction. Alternatively, a configuration may be possible in which the fixed contacts are disposed in the upper side of the swinging direction, and the movable contact abutment portions of the backstop are disposed in the lower side of the swinging direction.

In the electromagnetic relay, a portion of each of the fixed contact terminals that is retained by the fixed contact terminal retaining portion is formed of a plate-like member, and the plate surface extends in parallel to the sides of the base portion of the base block, and a portion of the backstop that is retained by the backstop retaining portion is formed of a plate-like member, and the plate surface extends in parallel to one of the remaining two opposing sides of the base portion of the base block.

In the electromagnetic relay, the backstop is formed into substantially a T-shape.

In the electromagnetic relay, the fixed contact terminal retaining portions and backstop retaining portion each have a shape protruding upward from the base portion of the base block and each have, at the protruded portion, a fitting hole for receiving insertion of the fixed contact terminal or backstop.

In the electromagnetic relay, the fixed contact terminal retaining portions and backstop retaining portion are formed integrally, and a projection of the shape of the integrally formed portion obtained by perpendicularly projecting the base block on its base portion has a U-shape.

In the electromagnetic relay, a portion between each of the fixed contact terminal retaining portions and backstop retaining portion in the base block has a protruding height from the base portion of the base block lower than the protruding heights of each of the fixed contact terminal retaining portions and backstop retaining portion from the base portion.

Advantages of the Invention

As described above, in the present invention, the fixed contact terminal retaining portions and backstop retaining portion retain the two fixed contact terminals and backstop respectively. The fixed contact terminal retaining portions are provided outside a projection obtained by perpendicularly projecting the movable contact spring on the surface of the base block so as to sandwich the part of the movable contact spring that extends from the base portion thereof toward the contact point. The backstop retaining portion retains the backstop at the portion outside the projection and opposite to the base portion of the movable contact spring. That is, in the case where the base block has rectangular shape, the above retaining portions are distributed to three different portions: left and right side portions of the base portion; and a portion along one side of the base portion which is positioned between the left and right side portions. Thus, sufficient spaces can be ensured between the two fixed contact terminals and between each of the fixed contact terminals and backstop, whereby a sufficient insulation distance can be ensured without providing a partition using the protrusion and the like adopted in Patent Document 1 and whereby the sizes of the fixed contact terminals and backstop each serving as a current carrying path can be increased.

The width directions of plates constituting the fixed contact terminals and width direction of a plate constituting the backstop are made substantially parallel to the left and right sides of the base plate of the base block having the fixed contact terminal retaining portions and backstop retaining portion and portion along one side of the base portion which is positioned between the left and right side portions. With this configuration, it is possible to reduce the thicknesses of the retaining portions, which in turn increases the coil winding width to thereby improve contact drive performance while maintaining the miniaturization.

The fixed contact terminals and backstop are fixed not to the flange portion of the coil bobbin, but to the fixed contact terminal retaining portions and backstop retaining portions provided in the base block. This means that members subject to heat of the coil and heat generated due to conduction between the contact terminals are separated from each other. Thus, even if a failure occurs while the movable contact and make fixed contact are being connected, there is no possibility of occurrence of a failure mode, as observed in the conventional approach, in which the flange portion is melt to cause the movable contact and fixed contact to be firmly fixed to each other while they are being connected to lead to malfunction in which current is not cut off but continues to flow. Further, since a structure in which the fixed contact terminals and backstop are press-fit and retained near the movable contacts or fixed contacts is not adopted, it is possible to avoid occurrence of electric contact trouble due to cutting scrap, etc.

As described above, according to the present invention, there can be provided an electromagnetic relay having a reduced size, high conductivity, a high insulating performance between the two fixed contact terminals and between each of the fixed contact terminals and backstop, a small number of factors causing a failure, and high reliability of electric contact.

BEST MODE FOR CARRYING OUT THE INVENTION

Embodiments of the present invention will be described below with reference to the accompanying drawings.

Figure 1:
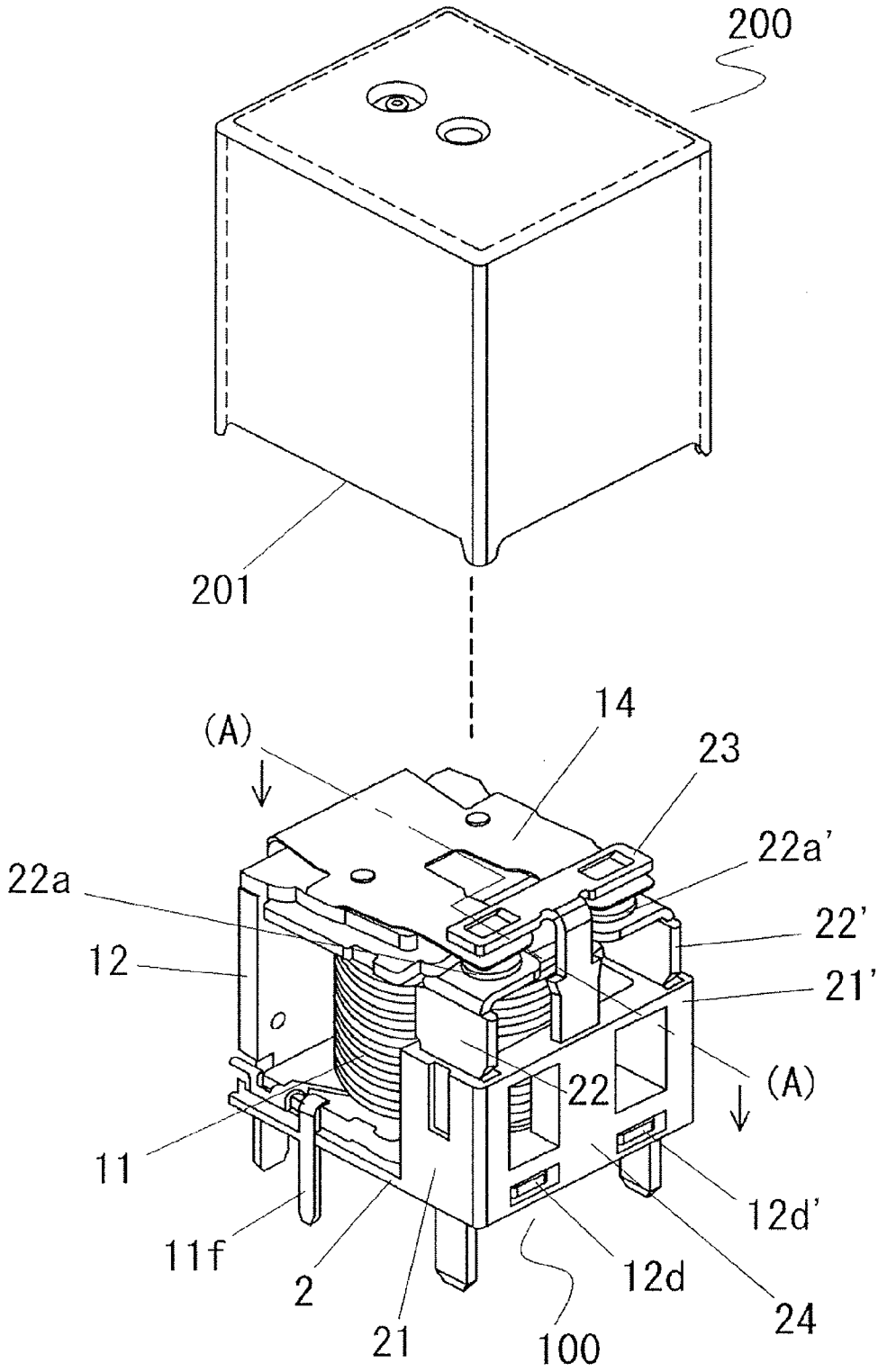
FIG. 1 illustrates an embodiment of an electromagnetic relay according to the present invention, which is a perspective view of a cover of an electromagnetic relay body and the electromagnetic relay body from which the cover is removed.
Figure 2:
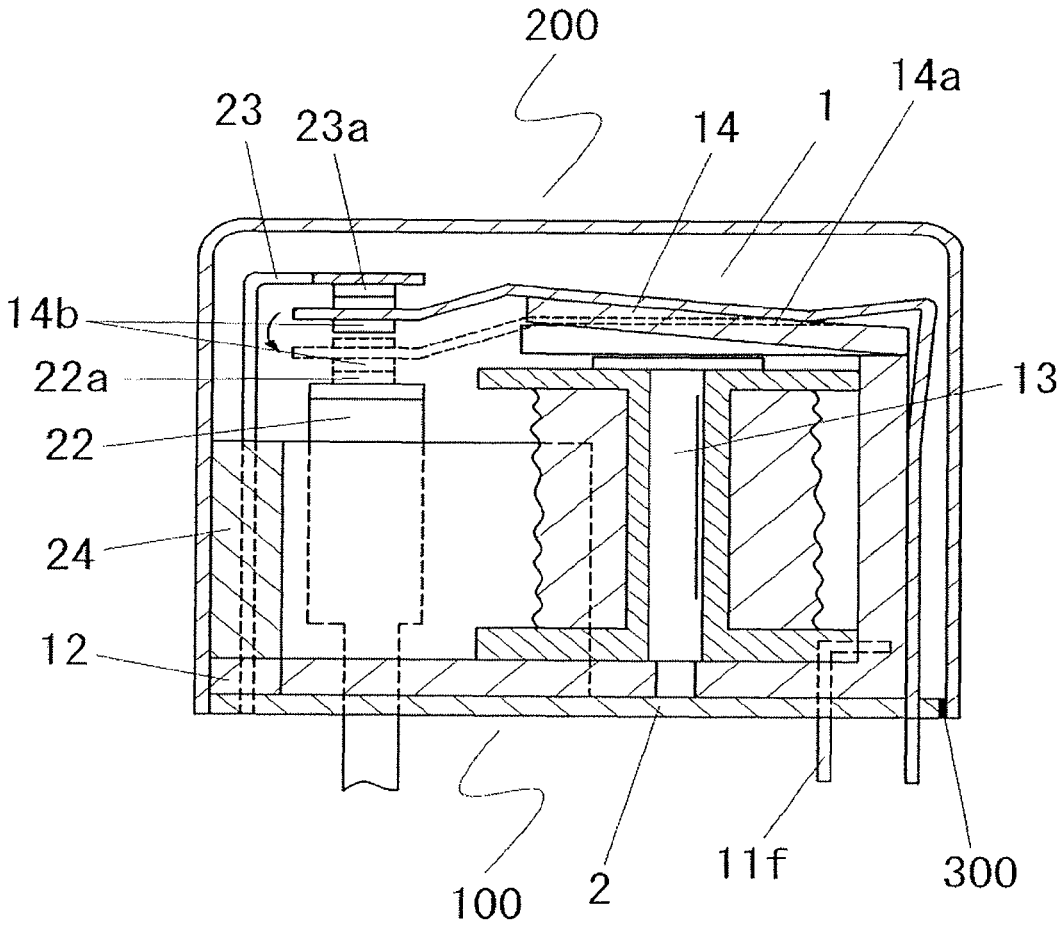
FIG. 2 is a vertical cross-sectional view of the electromagnetic relay, taken along (A)-(A) line of FIG. 1.

FIG. 1 illustrates an embodiment of an electromagnetic relay according to the present invention, which is a perspective view of a cover of an electromagnetic relay body and the electromagnetic relay body from which the cover is removed. FIG. 2 is a cross-sectional view of the electromagnetic relay, taken along (A)-(A) line of FIG. 1, and FIG. 3 is an exploded perspective view of the electromagnetic relay body of FIG. 1.

As illustrated in FIGS. 1 and 2, the electromagnetic relay in the present embodiment includes an electromagnetic relay body 100 and a cover 200 for covering the electromagnetic relay body 100. The electromagnetic relay body 100 includes an electromagnetic block 1 having a coil and a movable contact spring 14 swung by current flowing through the coil, two fixed contact terminals 22 and 22' having fixed contacts 22*a* and 22*a'* respectively, a backstop 23 having two movable contact abutment portions 23*a* and 23*a'*, and a base block 2 for retaining the electromagnetic block 1, fixed contact terminals 22 and 22' and backstop 23.

Figure 3:
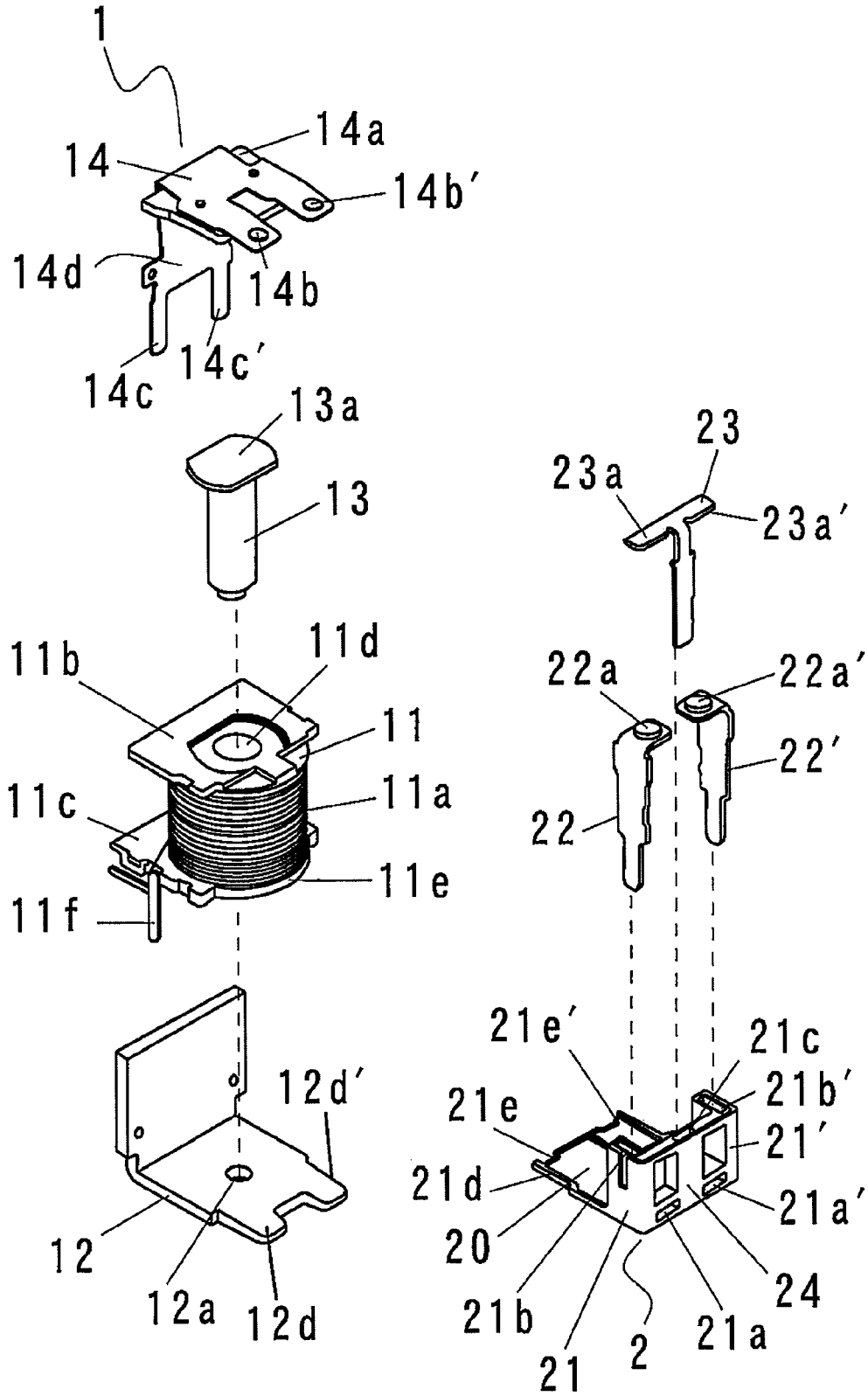
FIG. 3 is an exploded perspective view of the electromagnetic relay body of FIG. 1.

Further, as illustrated in FIGS. 1, 2, and 3, the movable contact spring 14 has a base portion 14*d* and a bifurcated configuration having two leading end portions. Movable contacts 14*b* and 14*b'* are provided at the two leading end portions of the bifurcated configuration. Two fixed contacts 22*a* and 22*a'* of the two fixed contact terminals 22 and 22' are provided at one side of the swinging direction of the two movable contacts 14*b* and 14*b'* so as to abut with the two movable contacts 14*b* and 14*b'* respectively, and two movable contact abutment portions 23*a* and 23*a'* of the backstop 23 are provided at the other side of the swinging direction of the two movable contacts 14*b* and 14*b'* so as to abut with the two movable contacts 14*b* and 14*b'* respectively. The base block 2 has substantially a rectangular base portion 20, fixed contact terminal retaining portions 21 and 21' extending vertically from two opposing sides of the rectangle so as to retain the two fixed contact terminals, and a backstop retaining portion 24 extending vertically from the center portion of one of the remaining two opposing sides of the rectangle. Hereinafter, the structure of the electromagnetic relay will be described more in detail.

The electromagnetic block 1 includes a coil assembly 11, a yoke 12, a core 13, and the movable contact spring 14 of bifurcated configuration having two leading end portions. The coil assembly 11 has upper and lower flange portions 11*b* and 11*c* and a coil bobbin 11*e* in the center of which a communication hole 11*d* is formed. A coil wire 11*a* is wound around the coil bobbin 11*e*, and the both end portions of the coil wire 11*a* are wound around a pair of plate-like coil terminals 11*f* inserted into the side surfaces of the lower flange portion 11*c* of the coil bobbin 11*e*.

The yoke 12 has two surfaces forming substantially a right angle, that is, has an L-shape. The leading end of the longer surface side to be disposed in parallel to the base portion of the base block has a bifurcated configuration and has a stepped shape formed such that the width of the leading end is reduced around the intersection with the coil terminal 11*f* so as to avoid contact with the coil terminal 11*f*. The electromagnetic block 1 is placed on the longer surface side of the yoke 12, and an engagement hole 12*a* to be engaged with the core 13 to be described later is formed in the longer surface side.

The core 13 is a shaft body having a predetermined length and has a flange-shaped locking portion 13*a* at its upper end and a stepped portion having reduced diameter at its lower end. After the coil assembly 11 is placed on the longer surface side of the yoke 12, the core 13 is inserted through the communication hole 11*d* and engagement hole 12*a*, and the lower end of the core 13 is press-fitted into the engagement hole 12*a* until the lower end is slightly protruded from the lower surface of the yoke 12 so as to increase the diameter of the engagement hole 12*a*, whereby the coil assembly 11, yoke 12, and core 13 are caulked together.

The movable contact spring 14 is a conductive and elastically deformable band plate member formed so as to be bent in substantially an L-shape. A plate-like armature 14*a* to be attracted by magnetic force is firmly fixed to the inside of one surface of the movable contact spring 14. The one surface of the movable contact spring 14 has a bifurcated configuration having two leading end portions, and movable contacts 14*b* and 14*b'* are provided around the two leading end portions of the bifurcated configuration so as to be protruded in both upper and lower directions. The movable contact spring 14 is firmly fixed to the back surface of the rising surface of the yoke 12 such that the armature 14*a* is positioned directly above the coil assembly 11.

In the electromagnetic block 1 having the configuration described above, when voltage is applied to a pair of coil terminals 11*f*, electromagnetic force is generated to cause the armature 14*a* positioned in the upper portion to be attracted to thereby swing the movable contacts 14*b* and 14*b'* in the lower direction. When the voltage is cut off, the movable contacts 14*b* and 14*b'* are swung in the upper direction by spring action.

The base block 2 is formed by a molding process and has the fixed contact terminal retaining portions 21 and 21' which are protruded from the base portion 20 of the base block 2 and each have substantially a U-shape as viewed from above and backstop retaining portion 24 integrally formed with the fixed contact terminal retaining portions 21 and 21'. The base block 2 further has second fitting holes 21*b* and 21*b'* into which the fixed contact terminals 22 and 22' are inserted respectively at the protruded portions of the fixed contact terminal retaining portions 21 and 21' and a third fitting hole 21*c* into which the backstop 23 at the protruded portions of the backstop retaining portion 24.

Further, first fitting hole 21*a* and 21*a'* in which the two leading end portions 12*d* and 12*d'* of the bifurcated configuration of the yoke 12 are fitted are formed at the lower portion of the surface on which the backstop retaining portion 24 of the integrally formed protruded portion is formed.

Further, a pair of first groove portions 21*d* for guiding the pair of coil terminals 11*f* are formed in the sides of the base portion 20 from which the fixed contact terminal retaining portions 21 and 21' are protruded, and second groove portions 21*e* and 21*e'* for guiding a pair of common terminals 14*c* and 14*c'* each serving as an external wiring connection portion provided at the leading end portion opposite to the movable contacts 14*b* and 14*b'* of the movable contact spring 14 are formed in the side opposite to the side from which the backstop retaining portion 24 of the base portion 20 is protruded.

The fixed contact terminals 22 and 22' are each formed of a plate-like member and each have a leading end bent in substantially an L-shape, and the fixed contacts 22*a* and 22*a'* are provided respectively at the bent leading end portions. The fixed contact terminals 22 and 22' are inserted to be fitted in the second fitting holes 21*b* and 21*b'* such that the plate surfaces thereof are substantially parallel to the sides of the base portion 20 of the base block and that the fixed contacts 22*a* and 22*a'* are positioned inside the sides of the base portion 20.

The backstop 23 is formed of a plate-like member and has substantially a T-shape. The head portion of the T-shape is bent in an L-shape, and movable contact abutment portions 23*a* and 23*a'* are provided at both side of the bent leading end portions. The backstop 23 is inserted to be fitted in the third fitting hole 21*c* such that the plate surfaces thereof are substantially parallel to the side of the base portion 20 of the base block and that the movable contact abutment portions 23*a* and 23*a*' are positioned inside the side of the base portion 20.

That is, the fixed contact terminals 22, 22' and backstop 23 are fixed such that the movable contact abutment portions 23*a*, 23*a*' and fixed contacts 22*a*, 22*a*' are positioned above and below the movable contacts 14*b* and 14*b*' respectively so as to sandwich the movable contacts 14*b* and 14*b*'. Further, the leading end portions 12*d* and 12*d*' of the yoke 12 constituting the electromagnetic block 1 are fitted to the first fitting holes 21*a* and 21*a*' respectively, and the pair of coil terminals 11*f* and common terminals 14*c*, 14*c*' protruded respectively from the side surfaces of the electromagnetic block 1 are loosely fit to the pair of first groove portions 21*d* and second groove portions 21*e* and 21*e*' respectively so as to be protruded downward from the base portion 20 of the base block 2. In this manner, the electromagnetic block 1 is placed on the base portion 20 of the base block 2.

The cover 200 is formed into a sealed box shape having an opening portion 201 having substantially the same dimension as the base block 2 so as to be capable of being loosely fitted to the base block 2. When the electromagnetic relay 100 is covered with the cover 200, the inner surface of the opening portion 201 is sealed to the peripheral edge of the base block 2 through a thermoset resin 300 (FIG. 2).

The electromagnetic relay in the present embodiment having the configuration described above operates as illustrated in FIG. 2. That is, before current is applied to the pair of coil terminals 11*f*, the movable contacts 14*b* and 14*b*' are kept being press-fitted against the movable contact abutment portions 23*a* and 23*a*' provided thereabove, that is, in this state, the movable contacts 14*b* and 14*b*' are kept being separated from the fixed contacts 22*a* and 22*a*'. When current is applied to the pair of coil terminals 11*f*, the armature 14*a* is attracted to the core 13 by electromagnetic force to cause the movable contacts 14*b* and 14*b*' to abut in a press-fit manner with the fixed contacts 22*a* and 22*a*', whereby the both contacts are closed.

Figure 4:
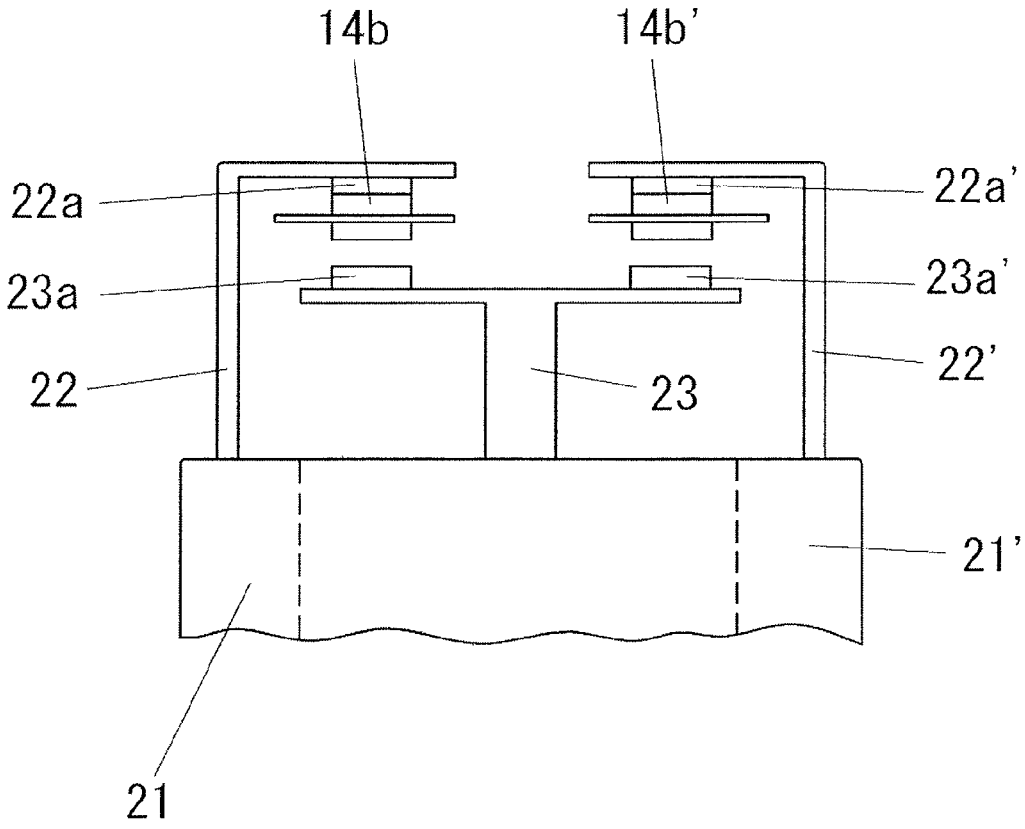
FIG. 4 illustrates an embodiment of an electromagnetic relay according to the present invention having a normally-closed contact, which is an enlarged view of the contact portion as viewed from the backstop retaining portion side.

FIG. 4 illustrates an embodiment of an electromagnetic relay according to the present invention having a normally-closed contact, which is an enlarged view of the contact portion as viewed from the backstop retaining portion side. The embodiment illustrated in FIG. 1 constructs a normally open contact in which the movable and fixed contacts are opened when current is not applied, while when the vertical positions of the fixed contacts 22*a*, 22*a*' and movable contact abutment portions 23*a*, 23*a*' are reversed, the normally closed contact can be constructed.

Figure 5:
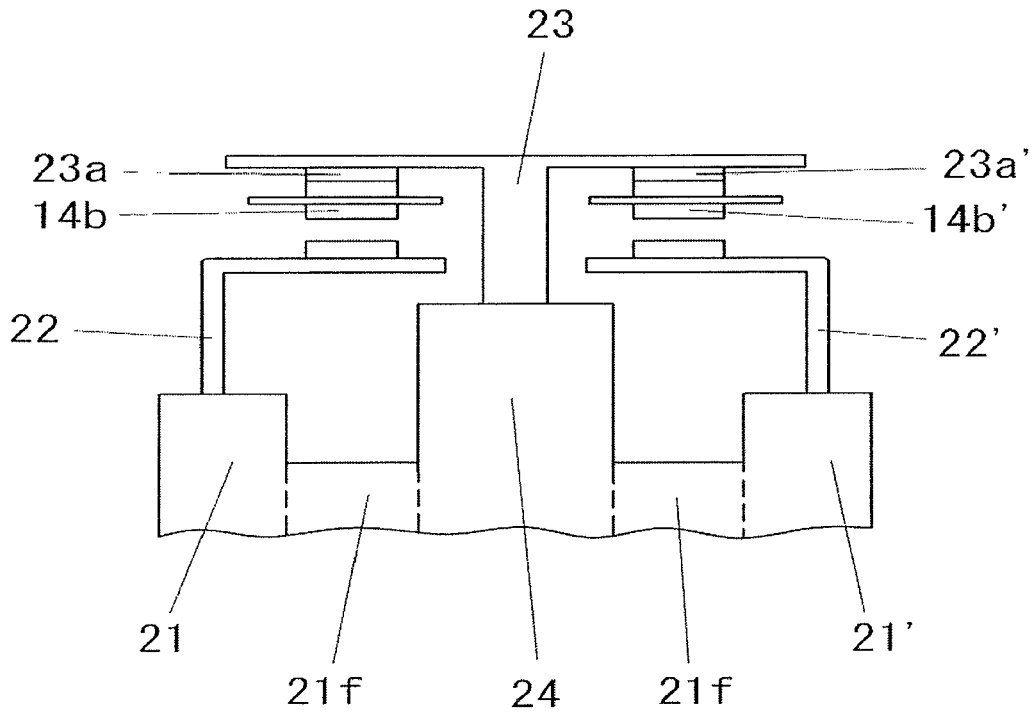
FIG. 5 illustrates an embodiment of an electromagnetic relay according to the present invention in which the insulation distance between the contacts is increased, which is an enlarged view of the contact portion as viewed from the backstop retaining portion side.

FIG. 5 illustrates an embodiment of an electromagnetic relay according to the present invention in which the insulation distance between the contacts is increased, which is an enlarged view of the contact portion as viewed from the backstop retaining portion side. As illustrated in FIG. 5, the height of separation portion 21*f* between each of the fixed contact terminal retaining portions 21 and 21' of the base block 2 and backstop retaining portion 24 is made lower than the protruding heights of each of the fixed contact terminal retaining portions 21 and 21' and backstop retaining portion 24, whereby the insulation distance between the terminals can further be increased.

INDUSTRIAL APPLICABILITY

As described above, according to the present invention, there can be provided an electromagnetic relay having reduced size, higher conductivity, a higher insulating performance between the two fixed contact terminals and between each of the fixed contact terminals and backstop, less number of factors causing a failure, and higher reliability of electric contact, as compared to conventional electromagnetic relays.

The electromagnetic relay of the present invention is not limited to the above embodiments, and shape, dimension, and the like may be selected as desired depending upon the application and usage performance.

The invention claimed is:

1. An electromagnetic relay comprising:

an electromagnetic block having a coil and a movable contact spring swung by current flowing in the coil;

two fixed contact terminals each provided with a fixed contact;

a backstop having two movable contact abutment portions; and a base block for retaining the electromagnetic block, fixed contact terminals, and backstop, wherein the movable contact spring has two movable contacts at its leading end portions extending from its base portion fixed to the base block, wherein the fixed contacts of the two fixed contact terminals are provided at one side of the swinging direction of the two movable contacts so as to abut with the two movable contacts respectively, and two movable contact abutment portions of the backstop are provided at the other side of the swinging direction of the two movable contacts so as to abut with the two movable contacts respectively, wherein the fixed contact terminals are retained by fixed contact terminal retaining portions which are provided outside a projection obtained by perpendicularly projecting the movable contact spring on the surface of the base block so as to sandwich the part of the movable contact spring that extends from the base portion thereof toward a contact point, wherein the backstop is retained by a backstop retaining portion which is provided at the portion outside the projection and opposite to the base portion of the movable contact spring, and wherein the base block has a base portion having substantially a rectangular surface, fixed contact terminal retaining portions extending vertically from two opposing sides of the rectangle so as to retain the two fixed contact terminals, and the backstop retaining portion extending vertically from the center portion of one of the remaining two opposing sides of the rectangle.

2. The electromagnetic relay according to claim 1, wherein the movable contacts are swung vertically with respect to the base portion of the base block, and wherein the movable contact abutment portions of the backstop are disposed in the upper side of the swinging direction, and the fixed contacts are disposed in the lower side of the swinging direction.

3. The electromagnetic relay according to claim 1, wherein the movable contacts are swung vertically with respect to the base portion of the base block, and wherein the fixed contacts are disposed in the upper side of the swinging direction, and the movable contact abutment portions of the backstop are disposed in the lower side of the swinging direction.

4. The electromagnetic relay according to claim 1, wherein a portion of each of the fixed contact terminals that is retained by the fixed contact terminal retaining portion is formed of a plate-like member, and the plate surface extends in parallel to the sides of the base portion of the base block, and wherein a portion of the backstop that is retained by the backstop retaining portion is formed of a plate-like member, and the plate surface extends in parallel to one of the remaining two opposing sides of the base portion of the base block.

5. The electromagnetic relay according to claim 1, wherein the backstop is formed into substantially a T-shape.

6. The electromagnetic relay according to claim 5, wherein the fixed contact terminal retaining portions and backstop retaining portion are formed integrally, and a projection of the shape of the integrally formed portion obtained by perpendicularly projecting the base block on its base portion has a U-shape.

7. The electromagnetic relay according to claim 1, wherein the fixed contact terminal retaining portions and the backstop retaining portion each have a shape protruding upward from the base portion of the base block and each have, at the protruded portion, a fitting hole for receiving insertion of the fixed contact terminal or backstop.

8. The electromagnetic relay according to claim 1, wherein a portion between each of the fixed contact terminal retaining portions and the backstop retaining portion in the base block has a protruding height from the base portion of the base block.

* * * * *